US005079395A

United States Patent [19]

Barnard et al.

[11] Patent Number: 5,079,395

[45] Date of Patent: Jan. 7, 1992

[54] ACTUATOR PLATE TYPE ELECTRICAL SWITCH ACTUATING MECHANISM

[75] Inventors: David A. Barnard, Middlebury; Glenn L. Murphy, Oxford, both of Conn.

[73] Assignee: Hubbell Incorporated, Orange, Conn.

[21] Appl. No.: 618,136

[22] Filed: Nov. 26, 1990

[51] Int. Cl.[5] ..... H01H 21/24

[52] U.S. Cl. ..... 200/557; 200/339; 200/558

[58] Field of Search ..... 200/339, 553, 557, 558, 200/559, 408, 409

[56] References Cited

U.S. PATENT DOCUMENTS

| | | | |
|---|---|---|---|
| 3,082,303 | 3/1963 | Wiley | 200/405 |
| 3,155,808 | 11/1964 | Wiley | 200/330 |
| 3,172,972 | 3/1965 | Schleicher | 200/557 |
| 3,178,530 | 4/1965 | Lawson | 200/557 |
| 3,371,179 | 2/1968 | Lohr | 200/339 X |
| 3,427,418 | 2/1969 | Norden | 200/339 |
| 3,684,847 | 8/1972 | Hoehn et al. | 200/453 |
| 3,916,128 | 10/1975 | McLaughlin | 200/557 |
| 4,221,941 | 9/1980 | Genovese | 200/339 X |
| 4,669,804 | 6/1987 | Munroe | 439/398 |

FOREIGN PATENT DOCUMENTS

| | | | |
|---|---|---|---|
| 209220 | 7/1957 | Australia | 200/558 |
| 803604 | 10/1958 | United Kingdom | 200/557 |

*Primary Examiner*—Henry J. Recla
*Assistant Examiner*—Glenn T. Barrett
*Attorney, Agent, or Firm*—G. H. Telfer; A. Mich, Jr.; M. R. Swartz

[57] ABSTRACT

An actuator plate type electrical switch employs an actuating mechanism which includes an overcentering cam, sleeve, actuator plate, plunger, and biasing spring. The cam is rotatable between first and second overcentered positions and has an actuating lobe aligned with a contact assembly causing the assembly to assume respective contact and non-contact positions upon rotation of the cam to corresponding first and second overcentered positions. The sleeve has a central passage and a transverse slot communicating with the passage. The cam is received through the transverse slot. The sleeve also mounts the actuator plate outwardly from the cam. The sleeve and actuator plate are pivotal together about an axis which extends parallel to the cam rotational axis. The plunger, biased by the spring toward and into continuous engagement with the center of the cam, is slidably mounted in the sleeve passage for reciprocal movement toward and away from the cam. The center of the cam is aligned with the center of the actuator plate so as to define portions of the plate which extend in opposite directions from its center and from the cam. The plunger by being biased toward the cam and actuator plate imposes a force on the cam which urges the cam to rotate toward and remain at one or the other of the first or second overcentered positions in response to manually pressing on one or the other of the opposite portions of the actuator plate.

17 Claims, 6 Drawing Sheets

ACTUATOR PLATE TYPE ELECTRICAL SWITCH ACTUATING MECHANISM

BACKGROUND OF THE INVENTION

1. Field of the Invention

The present invention relates generally to electrical wiring devices and, more particularly, is concerned with an actuating mechanism for an actuator plate type electrical switch for controlling the continuity of electrical circuits.

2. Description of the Prior Art

Wiring devices for controlling circuit continuity can have a variety of features. The features typically include contacts which, when engaged with each other, provide continuity for the associated circuit, and, when disengaged from each other, interrupt the circuit continuity. To control the operation of the contacts, and therefore the circuit continuity, actuating mechanisms of differing constructions are provided for forcing the contacts to and from their engaged position.

Various designs of wiring devices for controlling circuit continuity in residential and commercial applications advantageously employ switches with actuating mechanisms having substantially planar actuators to provide substantial continuity of the face of the switch with the surface of the wall in which the switch is mounted thereby affording a pleasing appearance consistent with interior decorating considerations. Examples of such designs are the ones disclosed in U.S. Pat. Nos. 3,082,303 and 3,155,808 to R. O. Wiley, which are assigned to the assignee of the present invention, U.S. Pat. No. 3,684,847 to Hoehn et al, and U.S. Pat. No. 4,669,804 to Munroe.

U.S. Pat. No. 3,684,847 to Hoehn et al discloses a switch employing an actuating mechanism having a pivotal rocker to which is attached a demountable tap or actuator plate. The actuator plate is generally rectangular in configuration and shaped in longitudinal section to form a large oblique angle between its left and right halves. The rocker has two oppositely disposed axles which are captured between the body and cover of the switch housing. A coil spring surrounds a cylinder portion of the rocker for producing an over-center snap-action as the actuator plate is pressed by a hand.

The ability to demount the actuator plate is a desirable commercial feature since it provides for simple interchange of actuator plates of different colors or designs. However, irrespective of the advantages of constructional simplicity, operational reliability and reduced manufacturing costs that may be associated with the switch design of the Hoehn et al patent, it has a significant drawback. The angle through which the actuator plate travels in moving between "on" and "off" switched positions is too large, for example approximately twenty-seven degrees. Because of this large angle, the height of the actuator plate outwardly from the wall detracts from a flush appearance with the wall. Furthermore, this design employs a heavy spring action which contributes to excessive sound and requires excessive force to operate the actuating mechanism. As a result, mating of the contacts involves high impact forces which tends to cause premature wear of the contacts.

Consequently, a need exists for a different switch construction which will result in reduction in the amount of mechanical travel of components and improvement of switch performance.

SUMMARY OF THE INVENTION

The present invention provides an actuator plate type electrical switch actuating mechanism designed to satisfy the aforementioned needs. In contrast to the actuator plate of the prior art Hoehn et al patent, the actuator plate of the switch actuating mechanism of the present invention travels a mere three degrees from a center location in either direction to respective "on" and "off" overcentered positions, although the overcentering cam of the actuating mechanism traverses a substantially greater distance, such as over twenty-eight degrees, in causing the contact assembly of the switch to make and break contact. The actuator plate of the actuating mechanism of the present invention thus appears to assume a more flush relationship with the wall than the actuator plate of the cited Hoehn et al patent.

Accordingly, the present invention is directed to an actuating mechanism for an actuator plate type electrical switch. The actuating mechanism includes an overcentering cam, a sleeve, an actuator plate, a plunger, and a biasing spring. The overcentering cam is rotatable between first and second overcentered positions and has an actuating lobe aligned with a contact assembly of the switch for causing the contact assembly to assume respective contact and non-contact positions upon rotation of the cam correspondingly to the first and second overcentered positions.

The sleeve of the actuating mechanism has a central passage and a transverse slot communicating with the passage. The overcentering cam is received through the transverse slot. The sleeve also mounts the actuator plate outwardly from the overcentering cam. The sleeve and actuator plate are pivotal together about an axis which extends substantially parallel to the rotational axis of the overcentering cam.

The plunger of the actuating mechanism is biased by the spring toward and into continuous engagement with the center of the cam. The plunger is also slidably mounted in the sleeve passage for reciprocal movement toward and away from the overcentering cam. The center of the cam is aligned with the center of the actuator plate so as to divide the plate into opposite end portions which extend in opposite directions from a center portion of the plate and from the cam. The plunger, by being biased toward and continuously engaged with the overcentering cam, imposes a force on the cam which urges the cam to rotate toward and remain at one or the other of the first or second overcentered positions of the cam in response to manually pressing on one or the other of the opposite end portions of the actuator plate.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
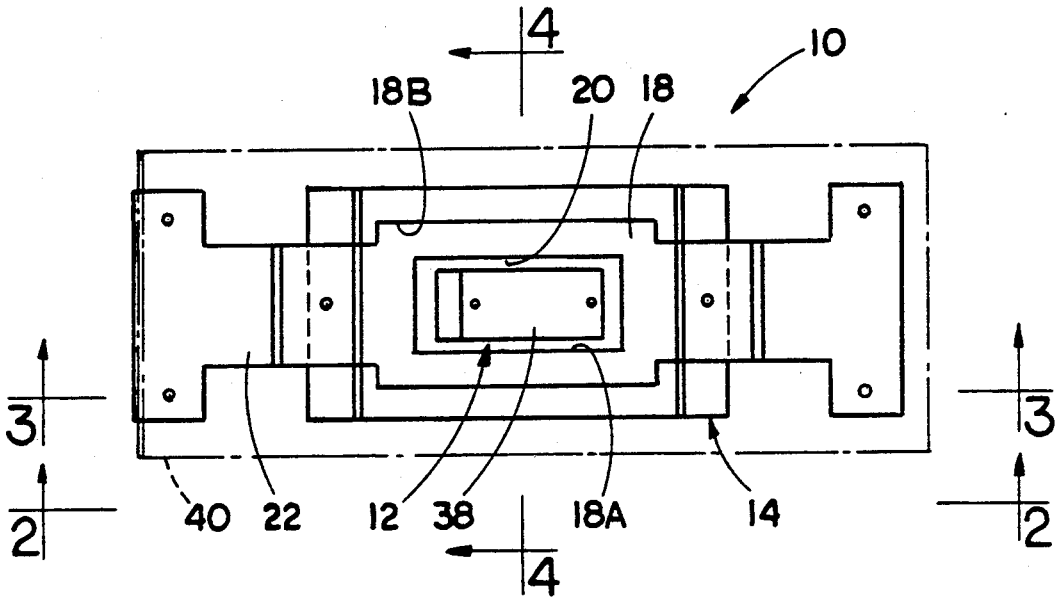
FIG. 1 is a plan view of a tap plate switch employing an actuating mechanism of the present invention.
Figure 2:
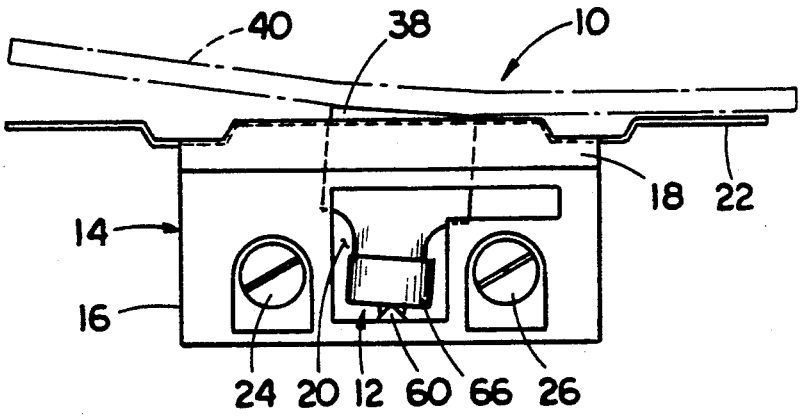
FIG. 2 is a side elevational view of the switch as seen along line 2—2 of FIG. 1.
Figure 4:
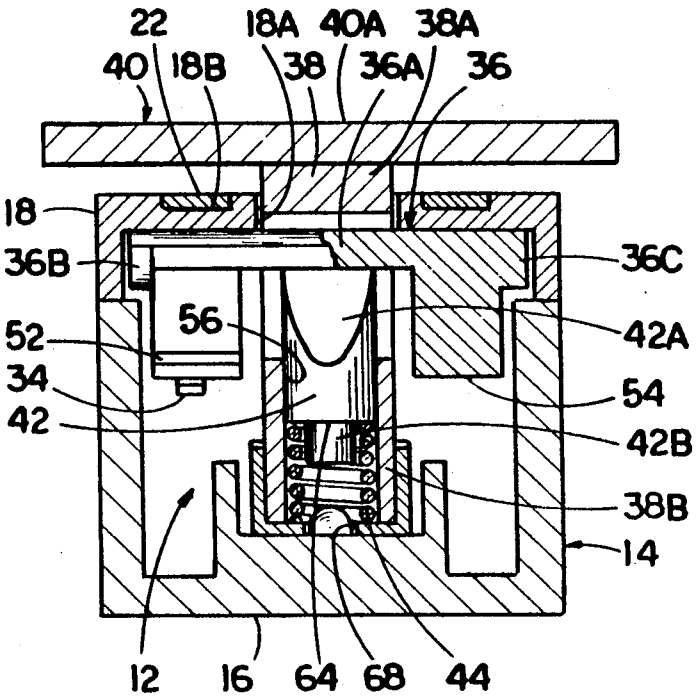
FIG. 4 is an enlarged transverse sectional view of the actuating mechanism taken along line 4—4 of FIG. 1.

In the following description, like references characters designate like or corresponding parts throughout the several views. Also in the following description, it is to be understood that such terms as "forward", "rearward", "left", "right", "upwardly", "downwardly", and the like, are words of convenience and are not to be construed as limiting terms.

In General

Referring now to the drawings, and particularly to FIGS. 1-6, there is illustrated an actuator plate type electrical switch, generally designated 10, which incorporates an actuating mechanism 12 in accordance with the present invention. The switch 10 includes a two-part housing 14 composed of a base 16 and a cover 18 having a central opening 18A. The base 16 defines an internal cavity 20. The switch 10 also includes a yoke 22 which seats in recesses 18B formed on the exterior of the cover 18. The cover 18 and yoke 22 are attachable together on the front side f the base 16 by fastening screws (not shown) that insert through the base 16 from its rear side. When the cover 18 is attached on the base 16, its central opening 18A overlies the cavity 20. The attached yoke 22 is used to mount the switch 10 to a wall.

In order to provide for making desired connections to electrical circuits, the switch 10 has electrical terminals 24 and 26 mounted to the housing base 16 in spaced and electrically isolated locations. The terminals 24 and 26 are connected to respective first and second electrical contacts 28 and 30 of a contact assembly 32 of the switch 10 for making and breaking an electrical connection. The first contact 28 is mounted to the base 16 in the cavity 20. The contact assembly 32 also includes an elongated arm 34 mounted at one end 34A to the base 16 in the cavity 20. The arm 34 has the second contact 30 attached to its outer free end 34B. As will be described in greater detail, the arm 34 is capable of being flexed by operation of the actuating mechanism 12 toward and away from the first contact 28 between contact and non-contact positions, as shown respectively in FIGS. 3 and 5. The second contact 30 mounted to the outer end 24B of the arm 34 is capable of making electrical contact with the first contact 28 upon flexing of the arm 34 toward the first contact 28.

Actuating Mechanism of Present Invention

Referring to FIGS. 3-6, there is illustrated the actuating mechanism 12 of the present invention which is employed by the electrical switch 10. The actuating mechanism 12 is mounted in the base cavity 20 and projects therefrom through the central opening 20A of the cover 20. Basically, the actuating mechanism 12 includes an overcentering cam 36, a sleeve 38, an actuator plate 40, a plunger 42, and a biasing spring 44.

Figure 3:
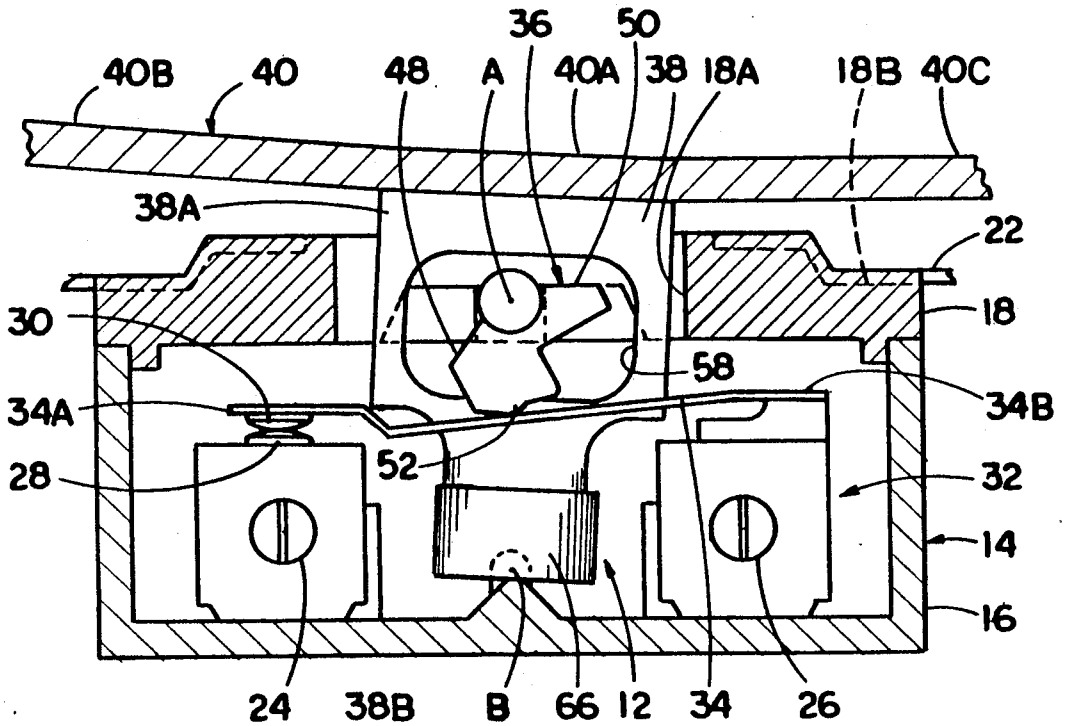
FIG. 3 is an enlarged off-centerline longitudinal sectional view of the switch taken along line 3—3 of FIG. 1 illustrating the position of the actuating mechanism of the switch when the switch is actuated to an "on" position.
Figure 6:
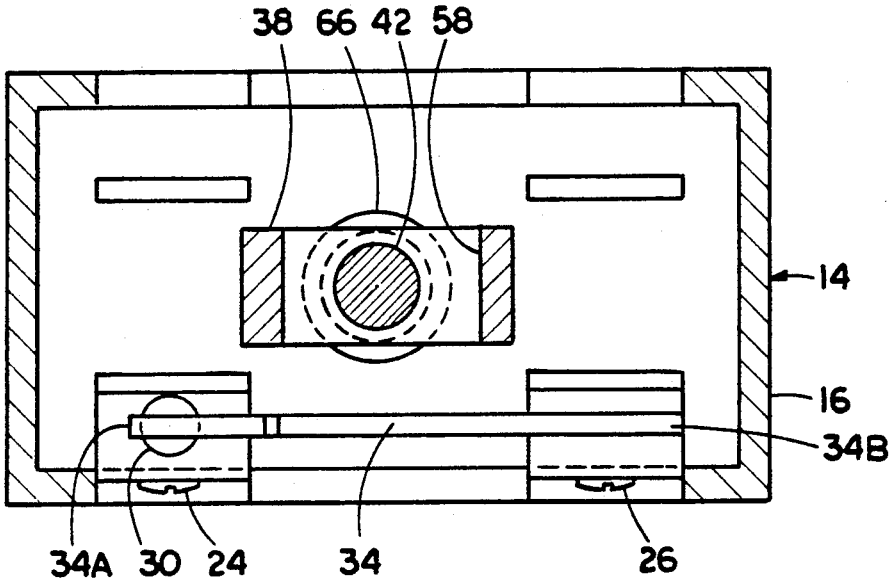
FIG. 6 is a longitudinal sectional view of the actuating mechanism taken along line 6—6 of FIG. 5.
Figure 5:
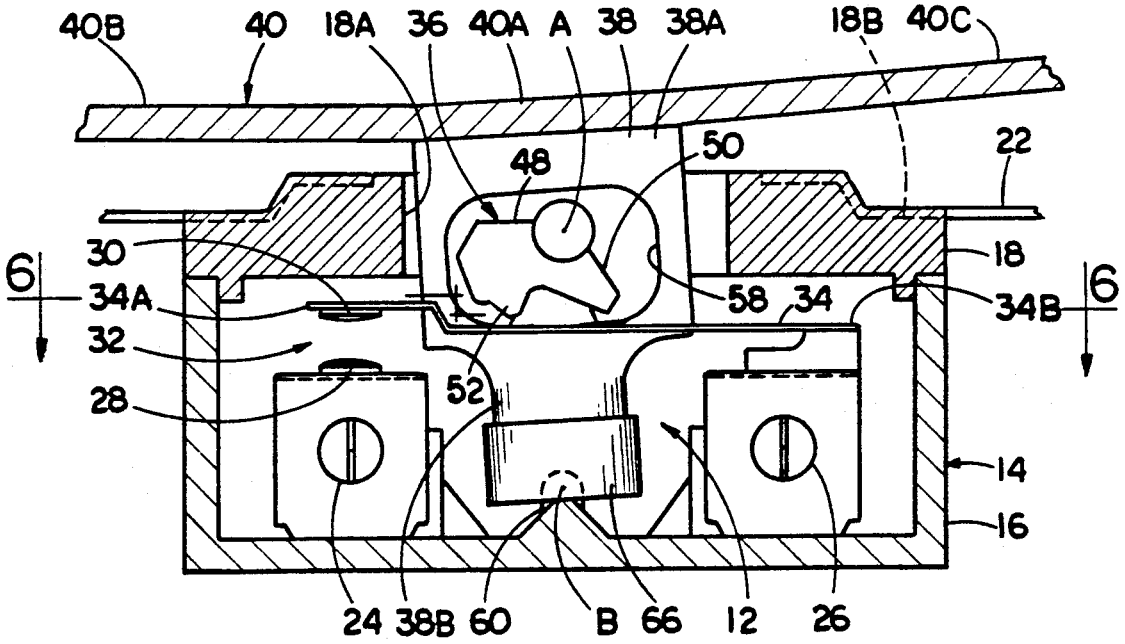
FIG. 5 is a view similar to that of FIG. 3 but illustrating the position of the actuating mechanism of the switch when the switch is actuated to an "off" position.
Figure 7:
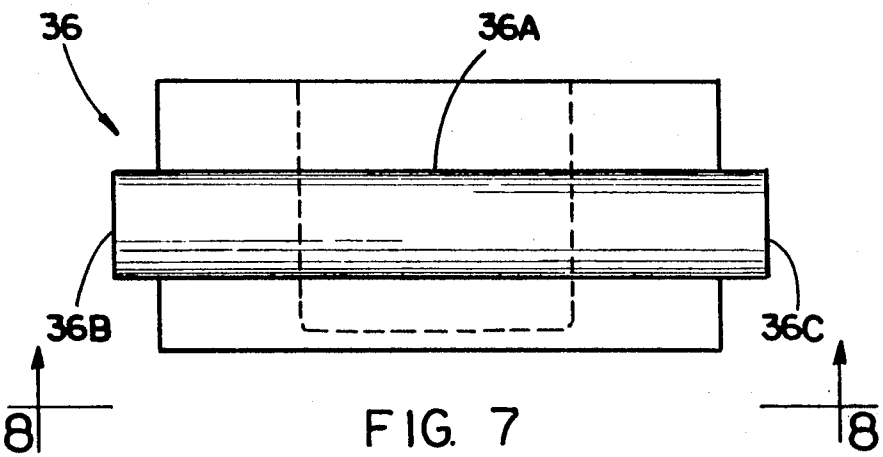
FIG. 7 is an enlarged top plan view of an overcentering cam of the actuating mechanism of FIG. 3 by itself.
Figure 8:
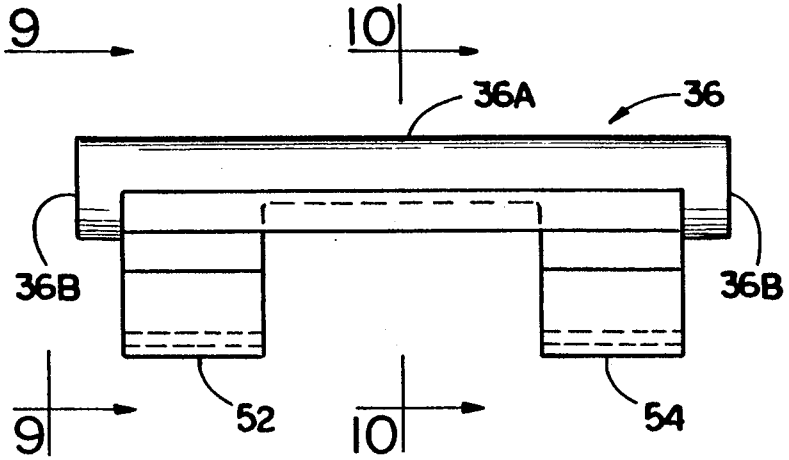
FIG. 8 is a side elevational view of the cam as seen along line 8—8 of FIG. 7.
Figure 18:
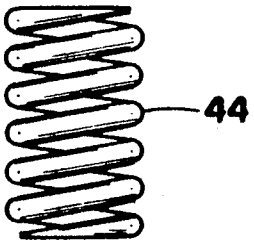
FIG. 18 is an enlarged side elevational view of a spring of the actuating mechanism of the switch of FIG. 3 by itself.
Figure 9:
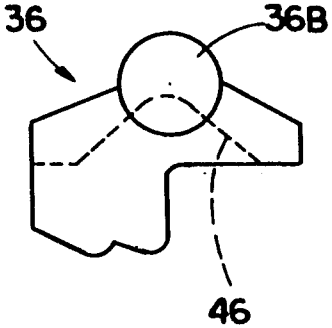
FIG. 9 is an end elevational view of the cam as seen along line 9—9 of FIG. 8.
Figure 17:
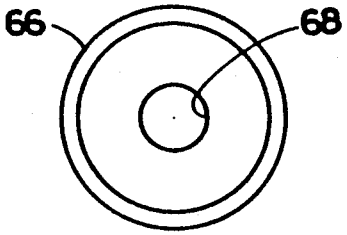
FIG. 17 is a top plan view of the retaining cap as seen along line 17—17 of FIG. 16.
Figure 16:
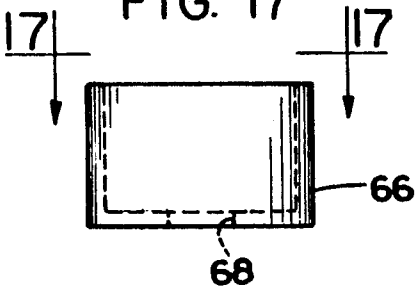
FIG. 16 is an enlarged side elevational view of a retaining cap of the actuating mechanism of the switch of FIG. 3 by itself.
Figure 10:
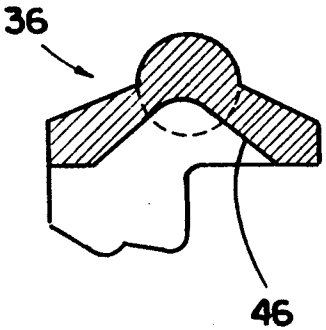
FIG. 10 is a transverse sectional view of the cam taken along line 10—10 of FIG. 8.
Figure 13:
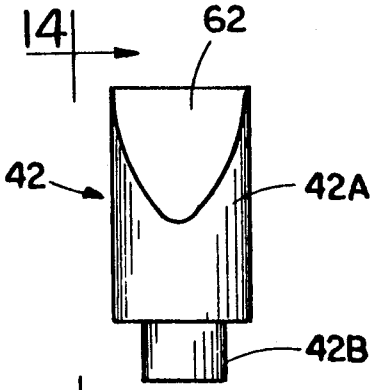
FIG. 13 is an enlarged side elevational view of a plunger of the actuating mechanism of the switch of FIG. 3 by itself.
Figure 14:
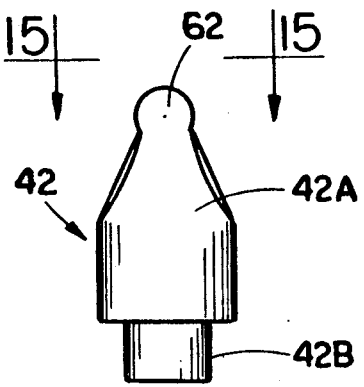
FIG. 14 is an end elevational view of the plunger as seen along line 14—14 of FIG. 13.
Figure 15:
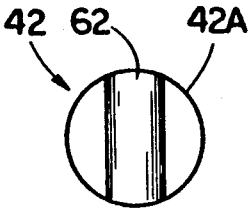
FIG. 15 is a top plan view of the plunger as seen along line 15—15 of FIG. 14.
Figure 12:
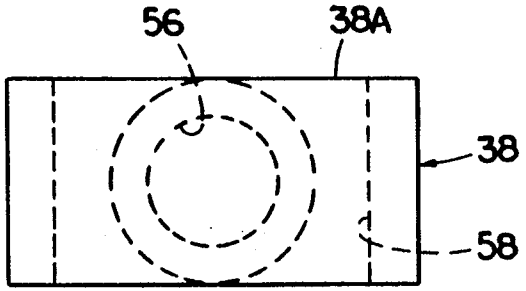
FIG. 12 is a top plan view of the sleeve as seen along line 12—12 of FIG. 11.
Figure 11:
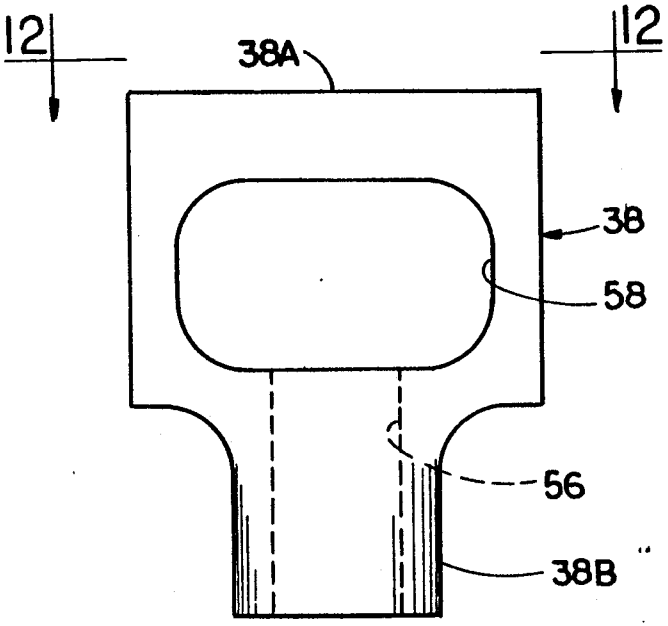
FIG. 11 is an enlarged side elevational view of a sleeve of the actuating mechanism of the switch of FIG. 3 by itself.
Figure 19:
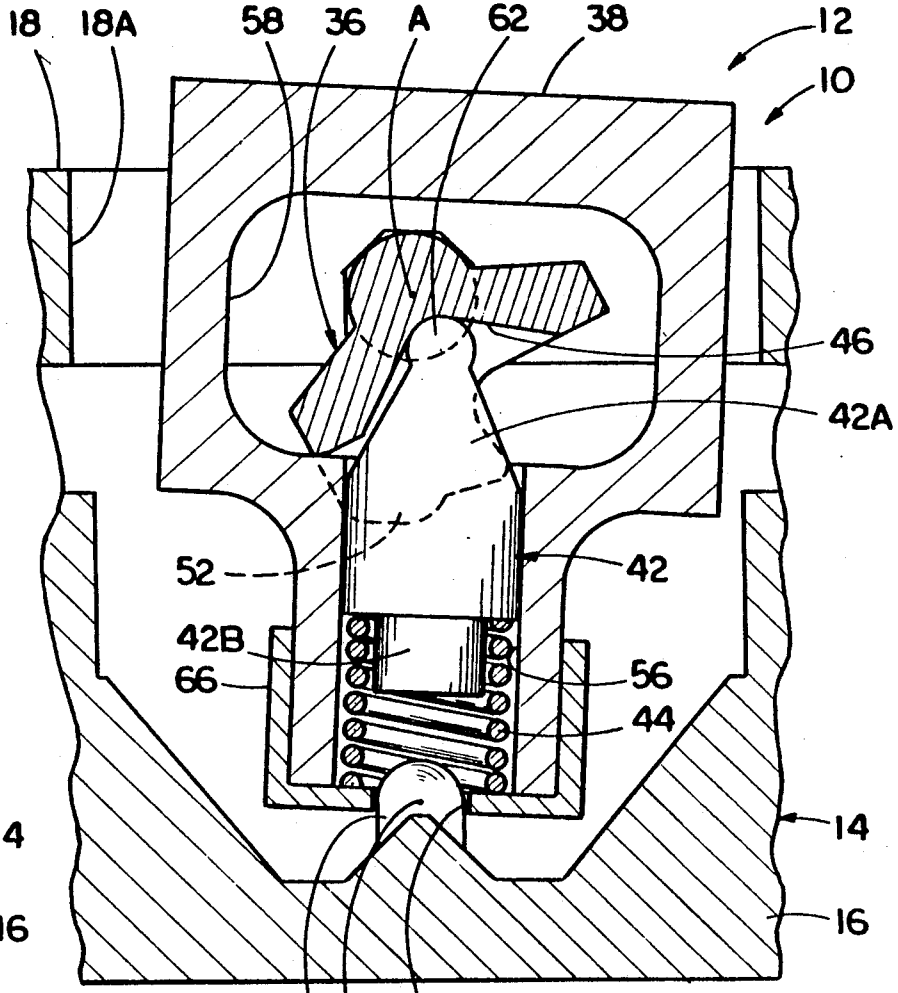
FIG. 19 is an enlarged fragmentary centerline longitudinal sectional view of the actuating mechanism of the switch of FIG. 3 illustrating the position of the actuating mechanism in the "on" position of the switch.
Figure 20:
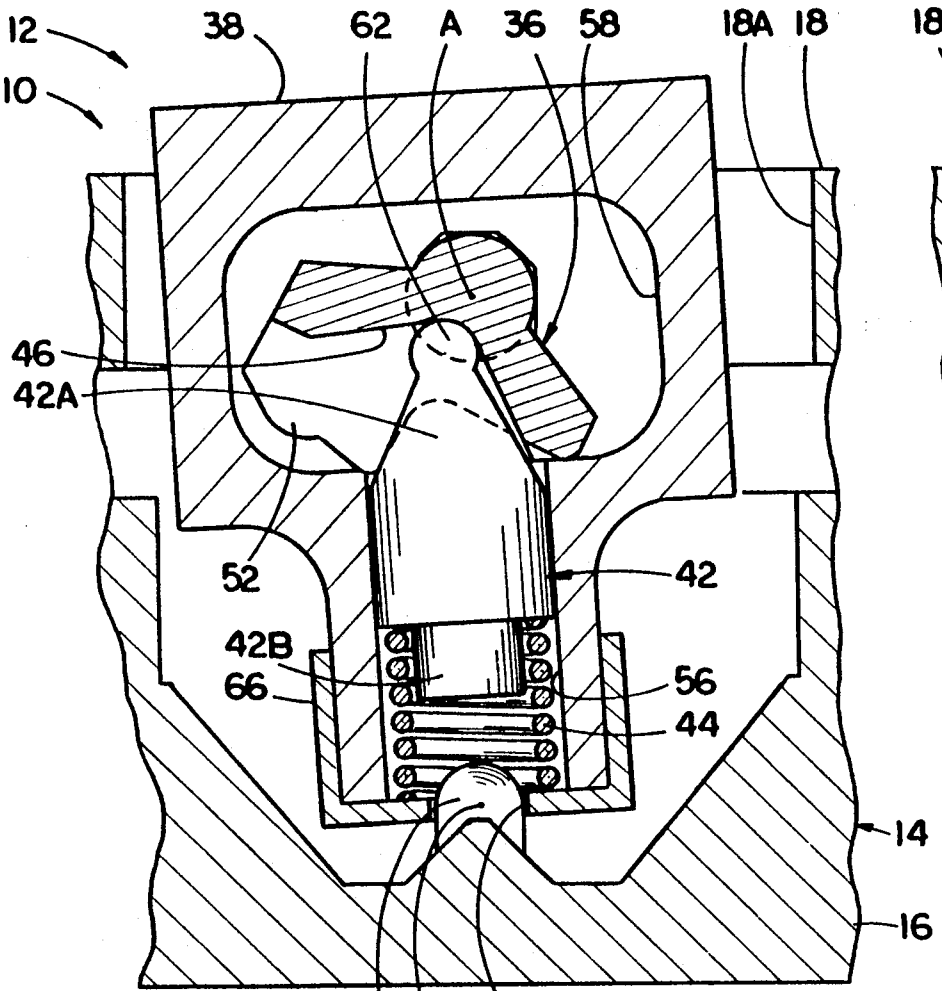
FIG. 20 is a view similar to that of FIG. 19 but illustrating the position of the actuating mechanism in the "off" position of the switch.

Referring to FIGS. 3-10, the overcentering cam 36 extends across the cavity 20 and is captured between the base 16 and cover 18 of the housing 14 for rotation between first and second angularly displaced overcentered positions, as seen respectively in FIGS. 3 and 5, about an axis A defined by a center portion 36A of the cam 36. The cam 36 has a recess 46 formed in its center portion 36A facing the interior cavity 20. The cam 36 also has first and second angularly displaced stop surfaces 48, 50 which limit the amount of rotation the cam 36 can undergo and a pair of actuating lobes 52, 54 angularly displaced from and disposed between the first and second stop surfaces 48, 50. The stop surfaces 48, 50 and actuating lobes 52, 54 are formed on opposite end portions 36B, 36C of the cam 36 located on opposite sides of the center portion 36A. The one actuating lobe 52 is aligned with the elongated contact assembly arm 34 and engages and respectively causes and permits the arm 34 to flex between previously-mentioned contact and non-contact positions upon corresponding rotation of the cam 36 to the first and second overcentered positions.

Referring to FIGS. 3-6, 11, 12, 19 and 20, the mounting sleeve 38 of the actuating mechanism 12 is disposed in the housing cavity 20 and projects through the housing cover opening 18A to an outer end 38A where the actuator plate 40 at a center portion 40A thereof is attached to the sleeve 38 and thereby disposed at the exterior of the housing cover 18. The sleeve 38 at its inner end portion has a central passage 56 and at its outer end portion has a transverse slot 58 which communicates with the passage 56 and is open at the opposite sides of the sleeve. The overcentering cam is received through the transverse slot 58 and projects in opposite directions beyond the sleeve 38. The actuator plate 40 mounted to the outer end 38A of the sleeve 38 is disposed outwardly from the overcentering cam 36.

The sleeve 38 at an inner end 38B is seated on a protrusion or dimple 60 formed on the interior of the housing base 16. The dimple 60 defines a fulcrum which permits the sleeve 38 and actuator plate 40 to pivot together from side-to-side about a pivotal axis B which extends in a direction substantially parallel to the rotational axis A of the overcentering cam 36.

Referring to FIGS. 3–6, 13–15, 9 and 20, the elongated plunger 42 of the actuating mechanism 12 is slidably mounted in the central passage 56 of the sleeve 38 for reciprocal movement toward and away from the overcentering cam 36. The plunger 42 has opposite outer and inner ends 42A, 42B. The plunger 42 at its outer end 42A projects from the passage 56 of the sleeve and has a tapered configuration terminating in a cylindrical edge 62 that engages the recess 46 in the center portion 36A of the cam 36 which has a complementary arcuate shape. At its inner end 42B, the plunger 42 has a reduced diameter which defines a shoulder 64 on the plunger 42.

Referring to FIGS. 3–6 and 16–20, the biasing spring 44 of the actuating mechanism 12 is disposed in the cavity 20 between a retaining cap 66 on the inner end 38B of the sleeve 38 and the shoulder 64 on the inner end 42B of the plunger 42. The retainer cap 66 has a central opening 68 into which projects the dimple 60 on the housing base 16. The coil spring 44 also extends within the passage 56 of the sleeve 38 and about the inner end 42B of the plunger 42. The spring 44 is so maintained in a compressed state biasing the plunger 42 into continuous engagement at its outer end 42B with the recess 46 in the cam 36.

Referring to FIGS. 3–6, it can be seen that the recess 46 in the center portion 36A of the cam 36 is aligned with the center portion 40A of the actuator plate 40 such that the actuator plate 40 is divided into opposite end portions 40B, 40C which extend in opposite directions from the center portion 40A of the plate and from the cam 36. The plunger 42, by being biased toward the cam 36 and actuator plate 40, thereby imposes a force on the cam that urges it to rotate toward and remain at one or the other of its first or second overcentered positions, as seen in FIGS. 3, 5, 19 and 20, in response to manually pressing on one or the other of the opposite portions 40B, 40C of the actuator plate 40.

It is thought that the present invention and many of its attendant advantages will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

We claim:

1. An actuating mechanism for an actuator plate type electrical switch, comprising:

(a) an overcentering cam rotatable about an axis defined by a center portion of said cam between first and second overcentered positions, said cam having an actuating lobe aligned with a contact assembly of the electrical switch for causing the contact assembly to assume respective contact and non-contact positions upon rotation of said cam correspondingly to said first and second overcentered positions;

(b) a sleeve having a central passage and a transverse slot communicating with said passage, said overcentering cam being received through said transverse slot;

(c) an actuator plate attached to an end of said sleeve and disposed outwardly from said overcentering cam, said sleeve and actuator plate being pivotal together about an axis which extends substantially parallel to said rotational axis of the overcentering cam, said center portion of said cam being aligned with a center portion of said actuator plate and dividing said plate into opposite end portions which extend in opposite directions from said center portions of said plate and cam; and (d) a plunger biased toward and into continuous engagement with said center portion of said overcentering cam and slidably mounted in said sleeve passage for reciprocal movement toward and away from said cam for imposing a force on said cam which urges said cam to rotate toward and remain at one or the other of said first or second overcentered positions of said cam in response to manually pressing on one or the other of said opposite end portions of said actuator plate.

2. The mechanism as recited in claim 1, wherein said cam includes first and second angularly displaced stops, said actuating lobe being angularly displace from and disposed between said first and second stops.

3. The mechanism as recited in claim 1, wherein said center portion of said cam includes a recess.

4. The mechanism as recited in claim 3, wherein said plunger has opposite ends, one of said opposite ends projecting from said passage of said sleeve into said slot of said sleeve and into said recess of said cam.

5. The mechanism as recited in claim 4, further comprising:

means disposed in said passage of said sleeve and being engaged with the other of said opposite ones of said plunger for biasing said plunger into continuous engagement with said cam.

6. The mechanism as recited in claim 5, wherein said biasing means includes a coil spring disposed within said sleeve passage.

7. The mechanism as recited in claim 6, wherein said biasing means also includes a cap fitting on an end of said sleeve for retaining said spring within said passage of said sleeve.

8. An actuating mechanism for an actuator plate type electrical switch, comprising:

(a) an overcentering cam having a center portion with a recess and being rotatable about a first axis between first and second angularly displaced overcentered positions, said cam having first and second angularly displaced stops and an actuating lobe angularly displace from and disposed between said first and second stops, said actuating lobe being alignable with a contact assembly of the switch for causing the contact assembly to assume a contact position upon rotation of said cam to said first overcentered position and for permitting the contact assembly to assume a non-contact position upon rotation of said cam to said second overcentered position;

(b) a sleeve having a central passage and a transverse slot communicating with said passage, said overcentering cam being received through and extending from said transverse slot;

(c) an actuator attached to an end of said sleeve and disposed outwardly from said overcentering cam, said sleeve and actuator plate being pivotal together about a second axis which extends substantially parallel to said first rotational axis of said overcentering cam, said center portion of said cam being aligned with a center portion of said actuator plate and dividing said plate int- opposite end portions which extend in opposite directions from said center portions of said plate and cam; and (d) a plunger having opposite ends and being slidably mounted in said passage of said sleeve for reciprocal movement toward and away from said cam, said plunger engaging said cam at one of said ends of said plunger projecting from said passage of said sleeve into said slot of said sleeve and into said central recess of said cam; and (e) means disposed in said passage of said sleeve and being engaged with the other of said ends of said plunger for biasing said plunger into continuous engagement with said cam and imposing a force on said cam which urges said cam to rotate toward and remain at one or the other of said first or second overcentered positions of said cam in response to manually pressing on one or the other of said opposite end portions of said actuator plate.

9. The mechanism as recited in claim 8, wherein said biasing means includes a coil spring disposed within said sleeve passage.

10. The mechanism as recited in claim 9, wherein said biasing means also includes a cap fitting on an end of said sleeve for retaining said spring within said passage of said sleeve.

11. An actuator plate type electrical switch, comprising:

(a) a housing having a base defining a cavity and a cover attached on said base and having a central opening overlying said cavity;

(b) a contact assembly for making and breaking an electrical connection, said contact assembly including (i) a first electrical contact mounted to said base in said cavity, (ii) an arm mounted to said base in said cavity and capable of being flexed toward and away from said first contact between contact and non-contact positions, and (iii) a second electrical contact mounted to said arm and contactable with said first contact upon flexing of said arm toward said first contact; and (c) an actuating mechanism mounted in said base cavity and projecting therefrom through said opening of said cover, said actuating mechanism including (i) an overcentering cam mounted to said housing for rotation about an axis defined by a center portion of said cam between first and second overcentered positions, said cam having an actuating lobe aligned with said arm of said contact assembly for causing said arm to assume respective contact and non-contact positions upon rotation of said cam correspondingly to said first and second overcentered positions;

(ii) a sleeve disposed in said cavity and extending through said central opening of said housing cover, said sleeve having a central passage and a transverse slot communicating with said passage, said overcentering cam being received through and extending beyond said transverse slot;

(iii) an actuator plate attached to an end of said sleeve extending through said opening of said housing cover and disposed outwardly from said overcentering cam, said sleeve at an opposite end being mounted to said housing base for pivotal movement such that said sleeve and actuator plate can pivotal together about an axis extending substantially parallel to said rotational axis of the overcentering cam, said center portion of said cam being aligned with a center portion of said actuator plate and dividing said plate into opposite end portions which extend in opposite directions from said center portions of said plate and cam, and (iv) a plunger biased toward and into continuous engagement with said center portion of said overcentering cam and slidably mounted in said sleeve passage for reciprocal movement toward and away from said cam for imposing a force on said cam which urges said cam to rotate toward and remain at one or the other of said first or second overcentered positions of said cam in response to manually pressing on one or the other of said opposite end portions or said actuator plate.

12. The switch as recited in claim 11, wherein said cam includes first and second angularly displaced stops, said actuating lobe being angularly displace from and disposed between said first and second stops.

13. The switch as recited in claim 11, wherein said center portion of said cam includes a recess.

14. The switch as recited in claim 13, wherein said plunger has opposite ends, one of said opposite ends projecting from said passage of said sleeve into said slot of said sleeve and into said recess of said cam.

15. The switch as recited in claim 14, further comprising:

means disposed in said passage of said sleeve and being engaged with the other of said opposite ones of said plunger for biasing said plunger into continuous engagement with said cam.

16. The switch as recited in claim 15, wherein said biasing means includes a coil spring disposed within said sleeve passage.

17. The switch as recited in claim 16, wherein said biasing means also includes a cam fitting on an end of said sleeve for retaining said spring within said passage of said sleeve.

* * * * *